US005477561A

United States Patent [19]

Adkins

[11] Patent Number: 5,477,561

[45] Date of Patent: Dec. 26, 1995

[54] HAIR MAINTENANCE CAP

[76] Inventor: Jennipher Adkins, P.O. Box 32121, Oakland, Calif. 94604

[21] Appl. No.: 323,223

[22] Filed: Oct. 14, 1994

[51] Int. Cl.[6] ..... A42B 1/00; A42C 1/00

[52] U.S. Cl. ..... 2/174; 2/171.04

[58] Field of Search ..... 2/171.04, 174, 2/181

[56] References Cited

U.S. PATENT DOCUMENTS

| | | | |
|---|---|---|---|
| 663,670 | 12/1900 | Wiswall | 2/174.04 |
| 1,300,644 | 4/1919 | Phillips | 2/171.04 |
| 2,889,557 | 6/1959 | Blair | 2/174 |
| 3,556,115 | 1/1971 | Benson | 2/174 X |
| 4,683,596 | 8/1987 | Cole | 2/174 |
| 5,249,308 | 10/1993 | Blume | 2/174 |

*Primary Examiner*—C. D. Crowder
*Assistant Examiner*—Shirra L. Jenkins

[57] ABSTRACT

A head garment comprising an exterior portion, a lining, and a stretch band. The garment is formed by folding a rectangular piece of material in half and sewing top and side edges of the folded material to leave an open bottom edge to create a lining. Next, except for a small portion which is left unattached an exterior circular piece of material are then sewn to the open bottom edge of the rectangular material. The folded rectangular and circular pieces of material are them pulled through the small opening left at the unattached portion and finally an elastic stretch band is sewn to the two pieces of material to form the finished garment.

2 Claims, 3 Drawing Sheets

HAIR MAINTENANCE CAP

BACKGROUND OF THE INVENTION

1. Field of the Invention

The present invention relates to a hair maintenance cap. This cap is designed for multiuses.

2. Description of Related Art

All my life I have settled with sleeping in tee-shirts, scarves bandanas, and even panties and stockings to maintain my hair. The reason is there is nothing being offered that gives users freedom with maintaining their hair, without fussing with tying knots while offering charm and style such as the present invention.

All hair, especially African-American hair needs a maintenance system, because of its unique curly texture and the fact that styles predominatly worn involve straightening the hair. Being an African-American woman, with a busy lifestyle, I need something that is convenient, easy to wear, easy to put on (in one step), healthy for my hair (satin), stays on my head while I sleep, is comfortable (2 inch stretch lace band), does not dry my hair out, and increases my hairs manageability, and is also fashionable to wear outdoors and coordinate with business and/or church attire.

There is nothing on the market that offers comfort, utility, and versitility as the present invention does.

In order to provide background information so that the invention may be completely understood and appreciated in its proper context reference is made to a number of prior art patents as follows: U.S. Pat. No. 1,300,644, tilted HAT, assigned to Phillips, 1919 is primarily an outdoor hat, containing stand-up brims and crowns for the purpose of outdoor use that can be folded and easily stored. This invention's purpose is to offer users a fashion hat, not a hair maintenance system to wear while sleeping. the lining of this invention further demonstrates the inventor's original intentions and purposes of this invention, it is non-specific (see line 97), a satin lining is not required.

U.S. Pat. No. 1,350,776, titled, BATHING HAT, assigned to Brogen, 1920, is a hat for swimming in. The intentions and purposes of this invention is to prevent water, from touching the hair while swimming. It is constructed of a waterproof material, which would cause the head to sweat while sleeping. This hat also has several elastic bands throughout its interior to keep the hat in place, which would not allow for comfort, or a protective, maintaining lining while sleeping.

U.S. Pat. No. 1,602,889, tilted, LADY'S CAP, assigned to Epstein, 1928, is a reversible cap with a stated intention and purpose as being for fashion. No satin lining or utility for this invention was stated in the patent. Perhaps what makes this invention unique is the design. However fashionable, it does not offer sleeping comfort, and with its special fastening feature, it is not an easy one step for putting on and taking off as the present invention is.

U.S. Pat. No. 2,052,123, titled, FLEXIBLE HEADWEAR, assigned to Adamson, 1936, is a beret consisting of a thick sweat band (see lines 40–45), that can also have a visor attached to the crown. This unisex cap does not cover the entire head of hair and is primarily for outdoor wear, not to be used as a hair maintenance item.

U.S. Pat. No. 2,356,042, titled, COMBONATION NON-ELASTIC ADJUSTABLE HAT BAND AND BOW TRIM HAT, assigned to Ferber, 1944, is a hat with bands that may be adjusted. This hat is designed primarily for outdoor use. It is not intended to cover the entire head of hair, and is not lined with satin. Nor is it designed to securly stay on the head, therefore not intended to be used as a hair maintenance item or to be worn while sleeping.

U.S. Pat. No. 3,556,115, titled, COIFFURE PROTECTOR, assigned to Benson, 1971, is large protective coiffure hat. The coiffure hairstyle is not a much worn hairstyle today. This invention is awkward and nonservicable to hairstyles of today. It is comprised of stiff side, front and back walls to give support to coiffure, thus making it unattractive to wear outdoors. The present invention is for all hairsyles.

There is nothing currently in the market that offers utility, versitlity, and comfort as the present invention. The said invention is simple yet an innovative hair maintenance system, that is easy to put on, even if the user is half asleep, covering all the hair. It is this act of covering the hair especially while sleeping that allows styles to last.

The object of my invention is to provide a cap that is worn at night to maintain styles and during the day outdoors as a fashion hat. The wide stretch band acts as a seal keeping the cap on the head confortably and adds style to cap the when wearing it for fashion.

SUMMARY OF INVENTION

This invention is a multi-functional head garmet that allows users to maintain their hair in various ways. This is partly achieved by using a preferred wide stretch band, connected to preferred oversized, square, not round, sating lining, to maintain hair styles, prevent dry scalp, increase hairs managability, does not dry out hair, and lays down and defines baby hair around the edge of hair line. It is designed for inexpensive production, is indeal for hair maintenance of all types of hair and hair styles and fashionable to wear outdoor attire.

DESCRIPTION OF PREFERRED EMBODIMENTS

Figure 1:
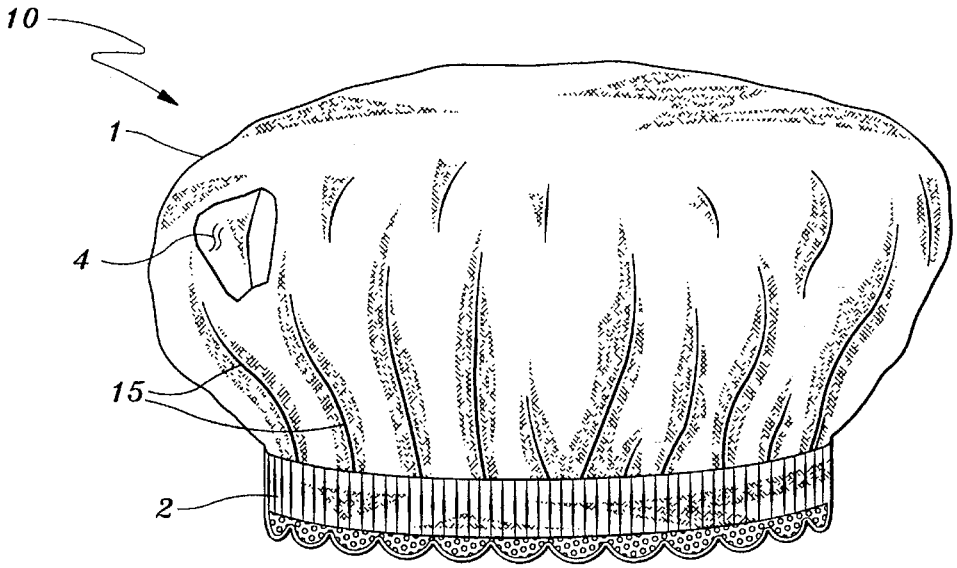
FIG. 1 is a perspective view of the hat in accordance with the present invention.
Figure 5:
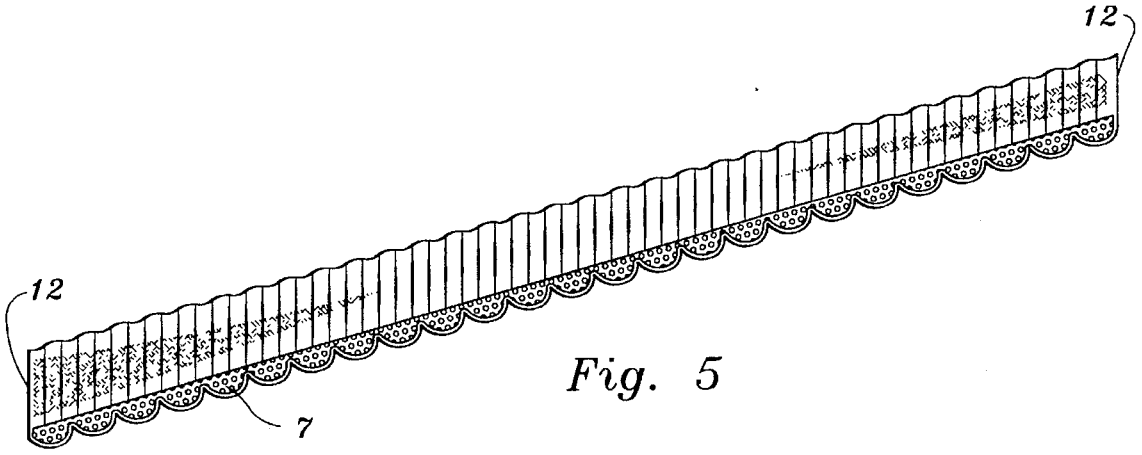
FIG. 5 is a perspective view of the stretchable band of the present invention prior to sewing.
Figure 6:
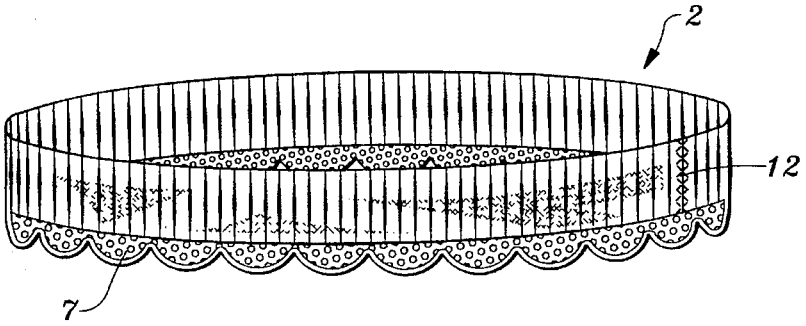
FIG. 6 is a perspective view of the stretchable band after sewing.

Referring now to the drawings, a head covering constructed in accordance with the present invention is generally indicated by 10. FIG. 1 shows the hat as it would be worn by the user. The hat is shown as having an exterior portion 1 covering a lining 4 with a stretchable band 2 portion which contacts the head of the wearer. The exterior portion 1 is made from an oversized material that is sewn to the lining 4 in a gathered fashion 15. As seen in FIGS. 1, 5 and 6, the stretchable band portion can be constructed from a fabric having a scalloped or ruffled edge 7.

Figure 2:
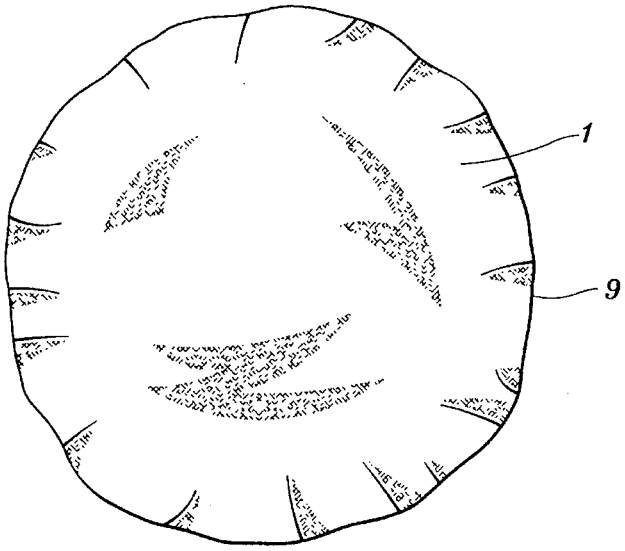
FIG. 2 is a top view of the exterior portion of the hat.

FIG. 2 isa top view of the exterior portion 1. It can be seen from the figure that the exterior portion is made from a circular piece of material. A variety of materials can be employed depending on the style desired by the wearer.

Figure 3:
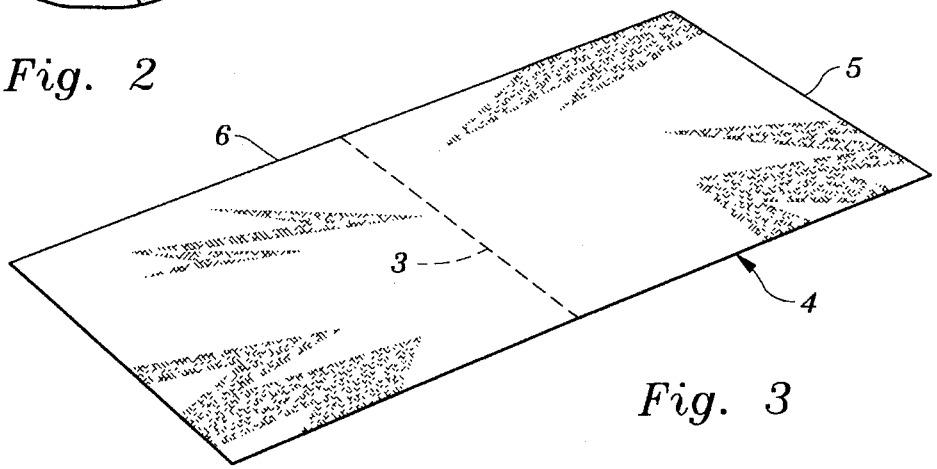
FIG. 3 is a perspective view of the living in the present invention before sewing.
Figure 4:
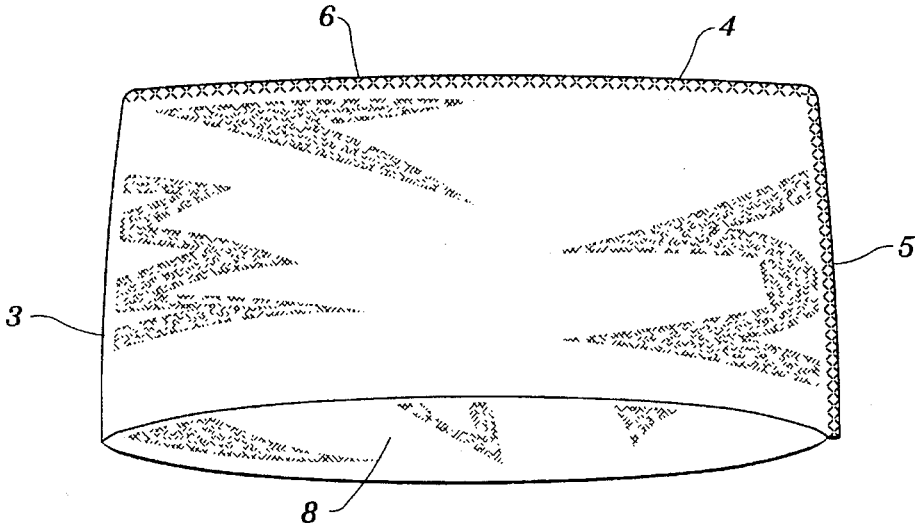
FIG. 4 is a perspective view of the lining of the present invention after sewing.

Referring now to FIG. 3, the lining portion 4 is shown as being made from a rectangular piece of material. Preferably, the lining material is made from a fabric that corresponds in color and style to the exterior portion 1, for example satin. The rectangular lining is folded in half as indicated at 3. The top portion 6 and side portion 5 are then sewn together as indicated in FIG. 4, leaving an open poriton 8 at the bottom.

FIG. 5 shows the stretchable band 2 of the present invention having a scalloped or ruffled edge. The end portions 12 of the stretchable band are sewn together to create a loop as seen in FIG. 6.

Figure 7:
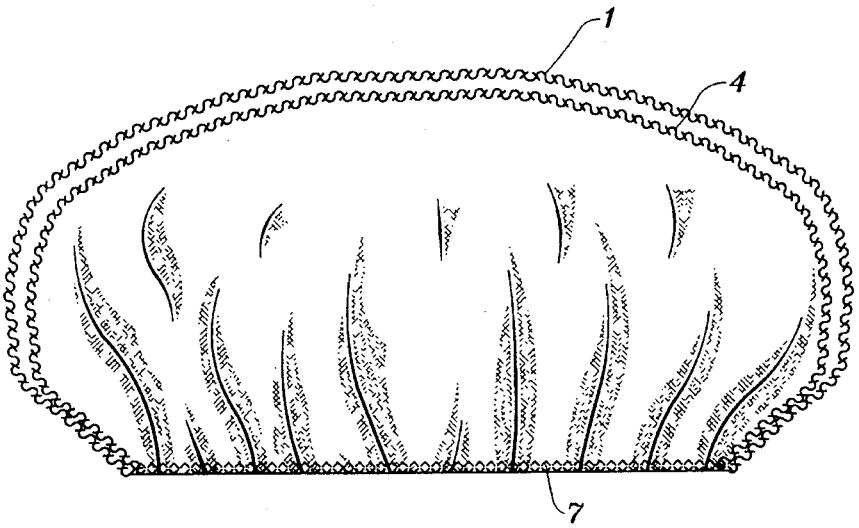
FIG. 7 is a cross sectional view of the lining sewn to the exterior portion.

The head covering is constructed by covering the sewn lining 4 with the exterior portion 1 and sewing or otherwise permanently attaching the outer periphery 9 of the exterior portion 1 along the outer periphery of the open portion 8 of the lining 4 leaving a small portion unattached 11 as seen in FIG. 7. The lining 4 and exterior portion 1 are then pulled through the unattached portion 11 effectively turning the hat inside out. Finally, the stretchable band 2 is sewn along the periphery of the open portion 8 of the lining 4. This results in the band 2 being disposed about the entire opening 8 of the lining 4 on the interior of the hat as well as closing the previously unattached poriton 11.

Figure 8:
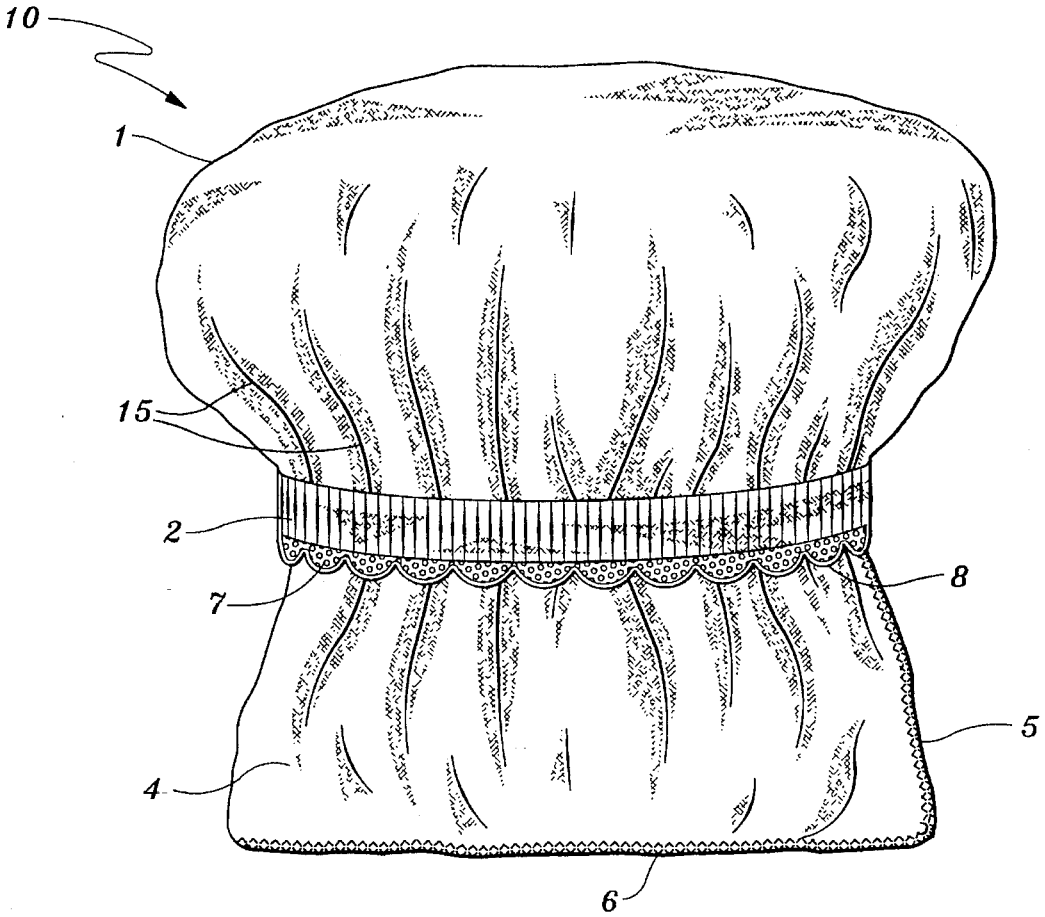
FIG. 8 is a perspective view of the invention after sewing all parte together with the lining pulled out for better viewing.

FIG. 8 shows the fully constructed hat with the lining pulled out in order to display the separate elements ofthe hat as they are sewn together.

What is claimed is:

1. A head covering comprising:

a lining made from a rectangular material folded in half and permanently attached together along the top portion and side portion leaving an open portion at the bottom;

an exterior portion made from a circular material permanently attached to the periphery of the open portion in a gathered fashion and covering said lining;

and a stretchable band portion attached to the periphery of the open portion of said lining for contacting the head of the wearer.

2. A method of producing a hat having the steps of:

providing a rectangular piece of material;

folding said rectangular material in half;

sewing the top and side portions together leaving an open portion at the bottom;

providing a circular material;

attaching said circular material around the periphery of said open protion of said rectangular material leaving a small portion unattached;

pulling said rectangular material and said circular material through said unattached portion;

providing a stretchable band;

sewing the ends of said elastic band together;

attaching said band to the periphery of said rectangular material and said circular material to form a head covering.

* * * * *